US005778561A

United States Patent [19]

Shimoyama

[11] Patent Number: 5,778,561

[45] Date of Patent: Jul. 14, 1998

[54] COMFORT INSOLE

[75] Inventor: Seiji Shimoyama, Tokyo, Japan

[73] Assignee: Shimoyama Shoji Co., Ltd., Tokyo, Japan

[21] Appl. No.: 815,751

[22] Filed: Mar. 12, 1997

[30] Foreign Application Priority Data

Nov. 27, 1996 [JP] Japan ..... 8-012127 U

[51] Int. Cl.[6] ..... A43B 13/38

[52] U.S. Cl. ..... 36/43; 2/239; 36/44

[58] Field of Search ..... 2/239; 36/43, 44, 36/153, 93, 88

[56] References Cited

U.S. PATENT DOCUMENTS

| | | | |
|---|---|---|---|
| 4,471,538 | 9/1984 | Pomeranz et al. | 36/43 |
| 4,802,289 | 2/1989 | Guldager | 36/43 |
| 4,991,317 | 2/1991 | Lakic | 36/43 |
| 5,005,575 | 4/1991 | Geri | 36/43 |
| 5,167,999 | 12/1992 | Wang | 36/44 |
| 5,625,965 | 5/1997 | Blissett et al. | 36/43 |

*Primary Examiner*—Gloria M. Hale

*Attorney, Agent, or Firm*—Kane, Dalsimer, Sullivan, Kurucz, Levy, Eisele and Richard, LLP

[57] ABSTRACT

A comfort in sole for use in a shoe or the like, wherein the comfort insole is composed of two strong, airtight and water-repellent sheets each of which has a shape corresponding to a shape of an inner sole of the shoe or the like, the two sheets being stuck to each other at their outer peripheral portions so as to form bag portions therein, wherein the comfort insole is sectioned into a frontmost portion, a tiptoe portion, a central portion, and a heel portion, wherein first fused lines are formed in the frontmost portion so as to form bag portions independently separated from each other, and wherein second fused lines are formed in the tiptoe portion, a third fused line is formed in the central portion, and a fourth fused line is formed in the heel portion, so that continuous bag portions are formed in a range including the second, third and fourth fused lines, and air is sealed in the continuous bag portions.

4 Claims, 3 Drawing Sheets

COMFORT INSOLE

BACKGROUND OF THE INVENTION

1. Field of the Invention

The present invention generally relates to comfort insoles for use on bottoms of footwear such as shoes or the like, and particularly relates to such comfort insoles in which shocks acting on the tiptoes and heels of feet in walking are absorbed by air pressure, and the movement of air at that time massages the soles of the feet to thereby contribute to promotion of health.

2. Description of the Prior Art

Conventionally, a comfort insoles of this kind has been formed in such a manner that two synthetic resin sheets each having the same shape as that of the inner sole of a shoe are put on each other and the outer peripheries of the resin sheets are fused each other to thereby form a sheet body, and jellied contents, for example, glycerol, or liquid contents, for example, alcohol, are sealed in the sheet body. This comfort insoles, however, has problems that the comfort insoles is not suitable for walking for a long time because the comfort insoles is heavy in weight, that when the comfort insoles is damaged, the contents thereof flow out to make a shoe or the like dirty to thereby give a user uncomfortable feeling, and that in the case of using jellied contents, the contents are leaned to one side and solidified thereat in walking on a long slope so that the sense of security of the foot is lost and the sole of the foot cannot be massaged.

SUMMARY OF THE INVENTION

An object of the present invention is therefore to provide a comfort insoles to be used on a bottom of footwear such as a shoe or the like in which the comfort insoles is light in weight and the content thereof can move smoothly in walking in any place so that the sense of security of the foot is not lost and the sole of the foot can be surely massaged to thereby contribute promotion of health, and even when the comfort insoles is damaged, it does not make the shoe or the like dirty.

In order to achieve the above object, according to an aspect of the present invention, a comfort insoles for use in a shoe or the like is provided, wherein the comfort insoles is composed of two strong, airtight and water-repellent sheets each of which has a shape corresponding to a shape of an inner sole of the shoe or the like, the two sheets being stuck to each other at their outer peripheral portions so as to form bag portions therein, wherein the comfort insoles is sectioned into a frontmost portion, a tiptoe portion, a central portion, and a heel portion, wherein first fused lines are formed in the frontmost portion so as to form bag portions independently separated from each other, and wherein second fused lines are formed in the tiptoe portion, a third fused line is formed in the central portion, and a fourth fused line is formed in the heel portion, so that continuous bag portions are formed in a range including the second, third and fourth fused lines, and air is sealed in the continuous bag portions.

In the above comfort insoles, preferably, one of the two strong, airtight and water-repellent sheets is made flat and a cloth sheet subjected to far-infrared and antimicrobial treatment is stuck on the flat sheet. Thus, the comfort insoles is excellent in the heat retaining property as well as the antimicrobial and deodorization property.

In the above comfort insoles, preferably, the second fused lines in the tiptoe portion are formed to direct respectively toward toes of a foot so as to support tiptoes of the foot uniformly in a width direction of the foot and so as to reduce air pressure acting on an instep of the foot. Thus, stimulus acting on the instep of a foot can be reduced.

In the above comfort insoles, preferably, the third fused line in the central portion is curved along a shank line to form a sufficiently large shank portion and a shank outside portion for correcting inclination of the foot. Thus, a large quantity of air can be supplied to the shank portion of the foot in walking so that the shank portion can be effectively stimulated, and in the case of walking in any place, the attitude of the foot can be held well.

In the above whole length sock, preferably, the fourth fused line in the heel portion is curved to be convex toward the central portion in accordance with a heel of the foot so as to absorb a shock acting on the heel, and both end portions of the fourth fused line are made to be substantially parallel to part of the outer peripheral portions adjacent to the end portions respectively so as to form long air suppressing portions for suppressing flow of air thereat. Thus, air is prevented from moving rapidly from the tiptoe to the heel or from the heel to the tiptoe in walking.

In the above comfort insoles, preferably, the continuous bag portions in the tiptoe portion are designed so as to support toes of a foot while bridging the toes respectively to thereby uniformly support tiptoes of the foot in a widthwise direction of the foot and so as to reduce air pressure acting on an instep of the foot, and wherein the fourth fused line in the heel portion is curved to be convex toward the central portion in accordance with a heel of the foot so as to absorb a shock acting on the heel, and both end portions of the fourth fused line are made to be substantially parallel to part of the outer peripheral portions adjacent to the end portions respectively so as to form long air suppressing portions for suppressing flow of air thereat, so that air flow is generated mainly at the central portion and at the heel portion alternately. Thus, the sole of the foot can be effectively massaged.

DETAILED DESCRIPTION OF THE PREFERRED EMBODIMENTS

Embodiments of the present invention will be described below with reference to the accompanied drawings.

Figure 1:
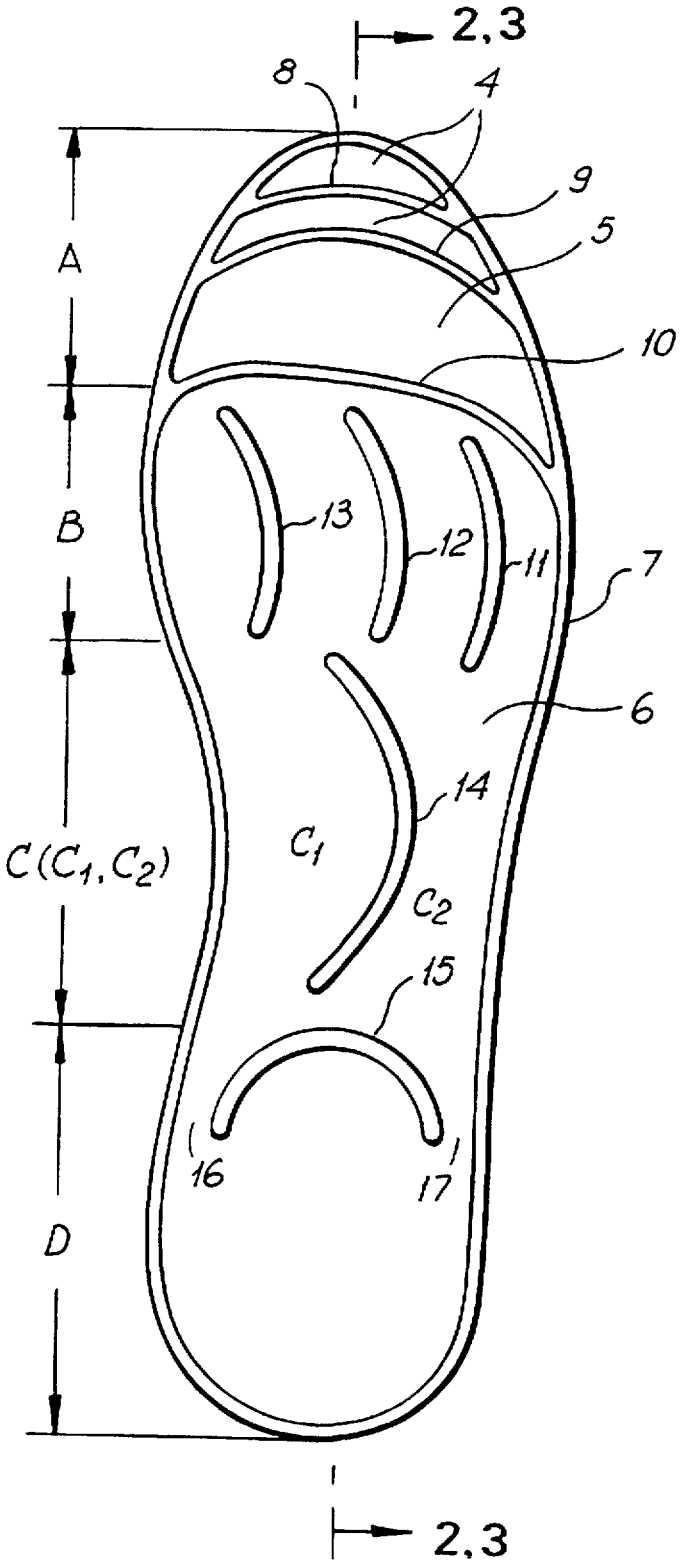
FIG. 1 is a plan showing the comfort insoles according to the present invention.
Figure 2:
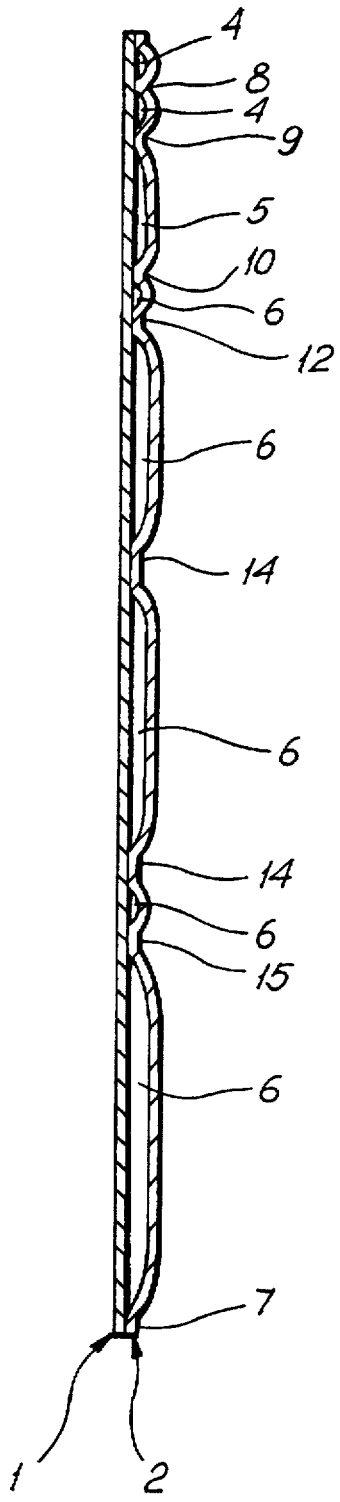
FIG. 2 is a section taken on line A—A of FIG. 1 showing a first embodiment of the present invention.

As shown in FIGS. 1 and 2, a comfort insoles is made from a strong, airtight and water-repellent vinyl sheet, for example, an ethylene vinyl alcohol sheet (an EVA sheet), and is formed in such a manner that a sole portion sheet 1 and an upper portion sheet 2 each corresponding to the shape of an inner sole laid in a shoe are stuck to each other and outer peripheral portions 7 of the sheets 1 and 2 are fused to each other. Fusing of the sheets 1 and 2 is performed by using, for example, a high-frequency welder.

The fused comfort insoles is sectioned, in the direction from the tiptoe to the heel, into a frontmost portion A, a tiptoe portion B, a central portion C, and a heel portion D.

In the frontmost portion A, fused lines 8, 9 and 10 are provided so as to be curved substantially corresponding to a curve drawn between the thumb and little toe of a foot and so as to reach outer peripheral portions 7. Bag portions 4 and 5 are formed by these fused lines 8, 9, and 10. In use of the comfort insoles, the plurality of bag portions 4 formed by the fused lines 8 and 9 are cut along any one of the fused lines so as to coincide with the size of a shoe. The interval between the fused lines 8 and 9 forming the bag portions 4 is selected to correspond to the size of a shoe.

Further, the sectioned tiptoe portion B, central portion C, and heel portion D are formed as a continuous bag portion 6 and air is sealed within the bag portion 6.

In the tiptoe portion B, a plurality of fused lines 11, 12, and 13 provided in the direction of toes of the foot and curved inward with respect to the foot are provided to bridge adjacent toes of the foot to thereby control the air pressure acting on the instep of the foot.

In the central portion C, a fused portion 14 is provided along a shank line of the foot so as to separate a bag portion of a shank portion $C_1$ from a bag portion of a shank-outside portion $C_2$ (hereinafter, simply referred to an outside portion $C_2$). The central portion C is designed so that a large quantity of air can enter the shank portion $C_1$, and the outside portion $C_2$ is formed so as to prevent the foot from being apt to slant outside.

In the heel portion D, a fused line 15 is provided so as to partly separate the heel portion D from the central portion C and so as to coincide with the shape of the heel of the foot. Both ends 16 and 17 of the fused line 15 are circularly curved toward the back of the foot, and two paths substantially parallel to each other are formed between the end 16 of the fused line 15 and the fused line of the outer peripheral portion 7, and between the other end 17 of the fused line 15 and the fused line of the other outer peripheral portion 7. The both-side paths act to induce air so that the flow of air is not suddenly changed in walking.

Further, each of the fused lines 8 to 15 is formed by using, for example, a high-frequency welder, in the same manner as in the case of fusing the outer peripheral portions 7. The formation of the fused lines 8 to 15 is performed after fusing of the outer peripheral portions 7.

Figure 3:
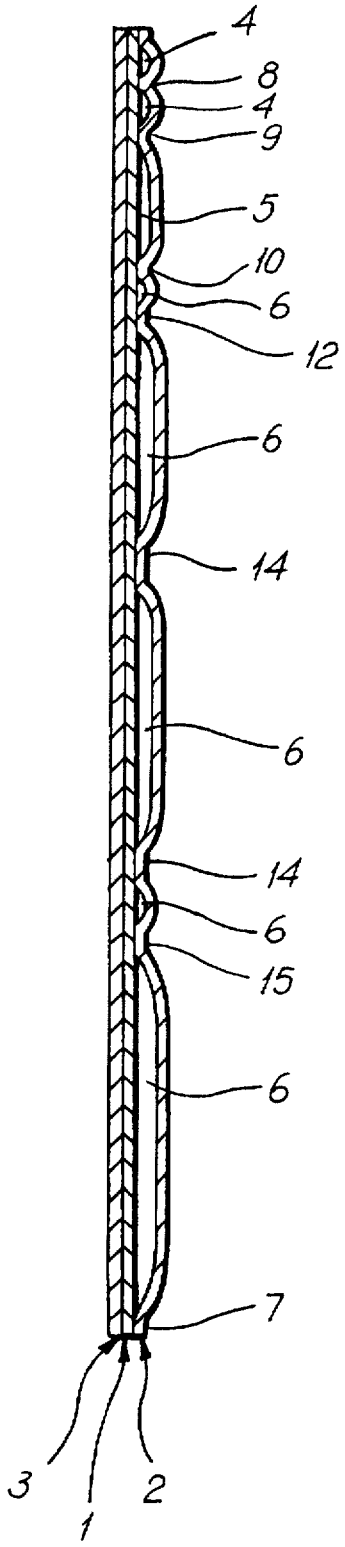
FIG. 3 is a section taken on line A—A of FIG. 1 showing a second embodiment of the present invention.

FIG. 3 shows another embodiment of the present invention. In this embodiment, the comfort insoles is formed so as to make a sole portion sheet 1 flat. A flat polyethylene cloth sheet 3 subjected to far-infrared and antimicrobial treatment is stuck on the back side of the sole portion sheet 1. An upper portion sheet 2 is formed so as to be slightly larger than the sole portion sheet 1 so that air can be sealed. The sheets 1 and 2 are fused with each other at their outer peripheral portions 7, and then fused lines 8 to 15 are formed.

As described above, the comfort insoles for footwear according to the present invention has such an excellent effect that a plurality of fused lines are provided so as to control movement of air from the heel to the tiptoe or from the tiptoe to the heel in accordance with the movement of a foot in walking so that the security of the foot in walking is not affected, the sole of the foot can be surely massaged, and because of enclosure of air in bag portions, the shoe or the like is never made dirty even in case of damage of the whole length sock.

Further, the comfort insoles according to the present invention has such an excellent effect that cloth sheets subjected to far-infrared and antimicrobial treatment are stuck to thereby improve the heat retaining property and the antimicrobial and deodorization property, a plurality of fused lines are provided so that stimulus acting on the instep of a foot can be reduced. Further, since a large quantity of air can be supplied to the shank portion of the foot in walking, the shank portion can be effectively stimulated. Furthermore, in the case of walking in any place, the attitude of the foot can be held well. Further, in the comfort insoles, air is prevented from moving rapidly from the tiptoe to the heel or from the heel to the tiptoe, and air flows mainly at the central portion and at the heel portion alternately to thereby effectively massage the sole of the foot.

What is claimed is:

1. A comfort insole for use in a shoe, wherein said comfort insole is composed of two strong, airtight and water-repellant sheets each of which has a shape corresponding to a shape of an inner sole of the shoe, said two sheets being stuck to each other at their outer peripheral portions so as to form bag portions therein, wherein said comfort insole is sectioned into a frontmost portion, a tiptoe portion, a central portion, and a heel portion, wherein first fused lines are formed in said frontmost portion so as to form bag portions independently separated from each other, wherein second fused lines are formed in said tiptoe portion, a third fused line is formed in said central portion, and a fourth fused line is formed in said heel portion, so that continuous bag portions are formed in a range including said second, third and fourth fused lines, and air is sealed in said continuous bag portions, and wherein said second fused lines in said tiptoe portion are formed to direct respectively toward toes of a foot so as to support tiptoes of the foot uniformly in a width direction of the foot and so as to reduce air pressure acting on an instep of the foot.

2. A comfort insole for use in a shoe, according to claim 1, wherein said third fused line in said central portion is curved along a shank line to form a sufficiently large shank portion and shank outside portion for correcting inclination of the foot.

3. A comfort insole for use in a shoe, according to claim 1, wherein said fourth fused line in said heel portion is curved to be convex toward said central portion in accordance with a heel of the foot so as to absorb a shock acting on the heel, and both end portions of said fourth fused lines are made to be substantially parallel to part of said outer peripheral portions adjacent to said end portions respectively so as to form long air suppressing portions for suppressing flow of air thereat.

4. A comfort insole for use in a shoe, according to claim 1, wherein said continuous bag portions in said tiptoe portions are designed so as to support toes of a foot while bridging said toes respectively to thereby uniformly support tiptoe of the foot in a widthwise direction of the foot and so as to reduce air pressure acting on an instep of the foot, and wherein said fourth fused line in said heel portion is curved to be convex toward said central portion in accordance with a heel of the foot so as to absorb a shock acting on the heel, and both end portions of said fourth fused line are made to be substantially parallel to part of said outer peripheral portions adjacent to said end portions respectively so as to form long air suppressing portions for suppressing flow of air thereat, so that air flow is generated mainly at said central portion and at said heel portion alternately.

* * * * *